US011331695B2

(12) United States Patent
Benedetti

(10) Patent No.: US 11,331,695 B2
(45) **Date of Patent: *May 17, 2022**

(54) APPARATUS FOR TREATING HORTICULTURAL PRODUCTS

(71) Applicant: UNITEC S.P.A., Lugo (IT)

(72) Inventor: Luca Benedetti, Ravenna (IT)

(73) Assignee: UNITEC S.P.A., Lugo (IT)

( * ) Notice: Subject to any disclaimer, the term of this patent is extended or adjusted under 35 U.S.C. 154(b) by 162 days.

This patent is subject to a terminal disclaimer.

(21) Appl. No.: 16/614,727

(22) PCT Filed: May 11, 2018

(86) PCT No.: PCT/IB2018/053296
§ 371 (c)(1),
(2) Date: Nov. 18, 2019

(87) PCT Pub. No.: WO2018/211385
PCT Pub. Date: Nov. 22, 2018

(65) Prior Publication Data

US 2020/0179983 A1 Jun. 11, 2020

(30) Foreign Application Priority Data

May 16, 2017 (IT) ..... 102017000052580

(51) Int. Cl.
*B07C 5/16* (2006.01)
*B07C 5/342* (2006.01)
*B07C 5/36* (2006.01)

(52) U.S. Cl.
CPC ..... *B07C 5/16* (2013.01); *B07C 5/342* (2013.01); *B07C 5/36* (2013.01); *B07C 2501/009* (2013.01)

(58) Field of Classification Search
CPC .. B07C 5/342; B07C 5/36; B07C 5/02; B07C 5/10; B07C 2501/009; B07C 5/16; B65G 2201/0211
See application file for complete search history.

(56) References Cited

U.S. PATENT DOCUMENTS 4,106,628 A * 8/1978 Warkentin ..... B07C 5/18 177/145
4,901,861 A * 2/1990 Cicchelli ..... A23N 4/00 198/690.2

(Continued)

FOREIGN PATENT DOCUMENTS

CL 2019003243 A1 2/2020
CN 1845861 A 10/2006

(Continued)

OTHER PUBLICATIONS

International Search Report dated Aug. 1, 2018 re: Application No. PCT/IB2018/053296, pp. 1-3, citing: EP 2 676 904 A1, EP 0 105 453 A2 and WO 96/40452 A1.

(Continued)

*Primary Examiner* — Michael McCullough
*Assistant Examiner* — Jessica L Burkman
(74) *Attorney, Agent, or Firm* — Cantor Colburn LLP

(57) ABSTRACT

An apparatus for treating horticultural products having in series at least: a first station, which includes first elements for the individual handling of respective horticultural products and at least one vision system, controlled by an electronic control and management unit, for the acquisition of information related to at least one parameter of interest of each horticultural product. The apparatus further includes a second station, including second elements for the individual handling of respective horticultural products and at least one device for weighing each horticultural product in transit, controlled by the electronic unit, and a third station, includ- (Continued)

ing third elements for the individual handling of respective horticultural products. The second station includes an intermediate unloading assembly, which can be actuated selectively by the electronic unit for the early release of the horticultural products, handled by the second elements.

10 Claims, 16 Drawing Sheets

(56) References Cited

U.S. PATENT DOCUMENTS

| | | | | |
|---|---|---|---|---|
| 6,533,126 | B1 * | 3/2003 | Parsons | B07B 13/075 209/617 |
| 2001/0032807 | A1 * | 10/2001 | Powell, Jr. | B07C 5/36 209/592 |
| 2007/0102265 | A1 | 5/2007 | Van Den Berg et al. | |
| 2013/0334109 | A1 * | 12/2013 | Liedl | B65G 43/08 209/541 |
| 2015/0283585 | A1 * | 10/2015 | Gual Pasalodos | G01N 21/8851 356/237.2 |
| 2015/0298175 | A1 * | 10/2015 | Kennedy | B07B 13/16 198/370.03 |

FOREIGN PATENT DOCUMENTS

| | | | |
|---|---|---|---|
| CN | 101121167 | A | 2/2008 |
| CN | 101507962 | A | 8/2009 |
| CN | 203428496 | U | 2/2014 |
| CN | 204182591 | U | 3/2015 |
| CN | 105057226 | A | 11/2015 |
| CN | 105251703 | A | 1/2016 |
| CN | 106000914 | A | 10/2016 |
| CN | 106140680 | A | 11/2016 |
| CN | 106564645 | A | 4/2017 |
| EP | 0105453 | A2 | 4/1984 |
| EP | 2676904 | A1 | 12/2013 |
| WO | 9640452 | A1 | 12/1996 |
| WO | 2015167345 | A1 | 11/2015 |
| WO | 2016042442 | A1 | 3/2016 |

OTHER PUBLICATIONS

IT Search Report dated Jan. 26, 2018 re: Application No. IT2017000052580, pp. 1-6, citing: EP 2 676 904 A1, EP 0 105 453 A2 and WO 96/40452 A1.

Written Opinion dated Aug. 1, 2018 re: Application No. PCT/IB2018/053296, pp. 1-4, citing: EP 2 676 904 A1, EP 0 105 453 A2 and WO 96/40452 A1.

* cited by examiner

APPARATUS FOR TREATING HORTICULTURAL PRODUCTS

CROSS REFERENCE TO RELATED APPLICATIONS

This application was filed under 35 U.S.C. § 371 as the national stage of International Patent Application No. PCT/IB2018/053296, filed on May 11, 2018, which claims priority to Italian Patent Application No. 102017000052580, filed on May 16, 2017, all of which said applications are hereby incorporated by reference in their entirety.

TECHNICAL FIELD

The present disclosure relates to an apparatus for treating horticultural products.

BACKGROUND

As is known, the gradual automation of processes involves an ever-increasing number of industrial sectors, since only in this way is it possible to combine the contrasting needs of the market, which on one hand requires ever lower costs and on the other hand still imposes high qualitative standards even on mass productions.

This trend can be observed easily also in the processing of horticultural products, where indeed it is now frequent to use completely or partially automated lines, often configured to perform different treatments on a specific horticultural product.

In greater detail, many companies in this sector acquire apparatuses or lines designed to be fed with unsorted masses of the product of interest, often coming directly from the harvest fields. These constructive solutions are thus composed of a plurality of stations, through which the product passes while indeed it is subjected to various treatments, checks and processes in general.

In this context, a type of apparatus is known, used for example in the processing of apples, wherein at least three stations follow one another sequentially.

The first station is fed with unsorted masses of apples, which thus have great heterogeneity in terms of dimensions, color, quality, et cetera; in said first station, the apples in transit pass through the field of action of a video camera, or other similar vision system, which is capable of performing qualitative analyses on the products, by checking their color, their degree of ripeness and/or the presence of defects (superficial or internal), as well as other properties and parameters of possible interest.

From said station, each apple is picked up by a respective clamp, which moves along a closed path, driven by a belt wound in a loop, in order to convey the apple toward the third station. Along the second station, each apple is weighed, and the information thus acquired, together with the information detected by the vision system, is provided to an electronic control and management unit, capable of activating selectively one of a plurality of unloading systems, which are distributed along the path that the apples follow in the third station.

Each unloading system is capable of guiding the apples in transit toward a respective collection basket, and thus while the apples advance progressively along the third station, as a function of the specific information acquired each apple is sent by the electronic unit to the appropriate basket, which can thus receive all and only the apples falling within preset parameters.

In this manner, downstream of the apparatus the users can find baskets with uniform content, to be sent to packaging to be then marketed (or, obviously, to undergo further treatments or checks).

This constructive solution, however, is not free from drawbacks.

As noted, the unloading system is located in the third station and therefore in the terminal part of the apparatus: this is obviously necessary, if one considers that the electronic unit has all the information required to send each apple to the appropriate basket only downstream of the second station.

However, this configuration entails that any rotten apples nonetheless travel along the entire preset path or at least along a long part thereof. If one considers that the apples move in a row and mutually close along the apparatus, due to obvious space containment requirements, this turns out to be highly unwelcome, since the rotten apples can deteriorate the healthy ones that are adjacent to them as well. Furthermore, any residues of the rotten apples may contaminate the elements assigned to their handling, which transfer impurities and defects to the apples that said elements convey to the next cycle.

More generally, the need is now felt to be able to evacuate in advance and in a timely manner part of the apples in transit on the basis of criteria that can be preset at will case by case.

SUMMARY

The aim of the present disclosure is to solve the problems described above, by providing an apparatus for treating apples or other horticultural products that offers practical methods of early evacuation of the products in transit.

Within this aim, the disclosure provides an apparatus that is capable of identifying and segregating in advance and in a timely manner apples or other horticultural products that are rotten.

The disclosure also provides an apparatus that offers a further option for sorting and segregation of apples or horticultural products in transit.

The disclosure further provides an apparatus that is capable of combining modest space occupation and high productivity.

The disclosure also provides an apparatus that ensures high reliability in operation.

The disclosure proposes an apparatus that adopts a technical and structural architecture that is alternative to those of apparatuses of the known type.

The disclosure further provides an apparatus that can be obtained easily starting from commonly commercially available elements and materials.

The disclosure also provides an apparatus that has modest costs and is safe in application.

This aim and these and other advantages which will become better apparent hereinafter are achieved by providing an apparatus according to claim 1.

BRIEF DESCRIPTION OF THE DRAWINGS

Further characteristics and advantages of the disclosure will become better apparent from the description of a preferred but not exclusive embodiment of the apparatus according to the disclosure, illustrated by way of nonlimiting example in the accompanying drawings, wherein.

DETAILED DESCRIPTION OF THE DRAWINGS

Figure 1:
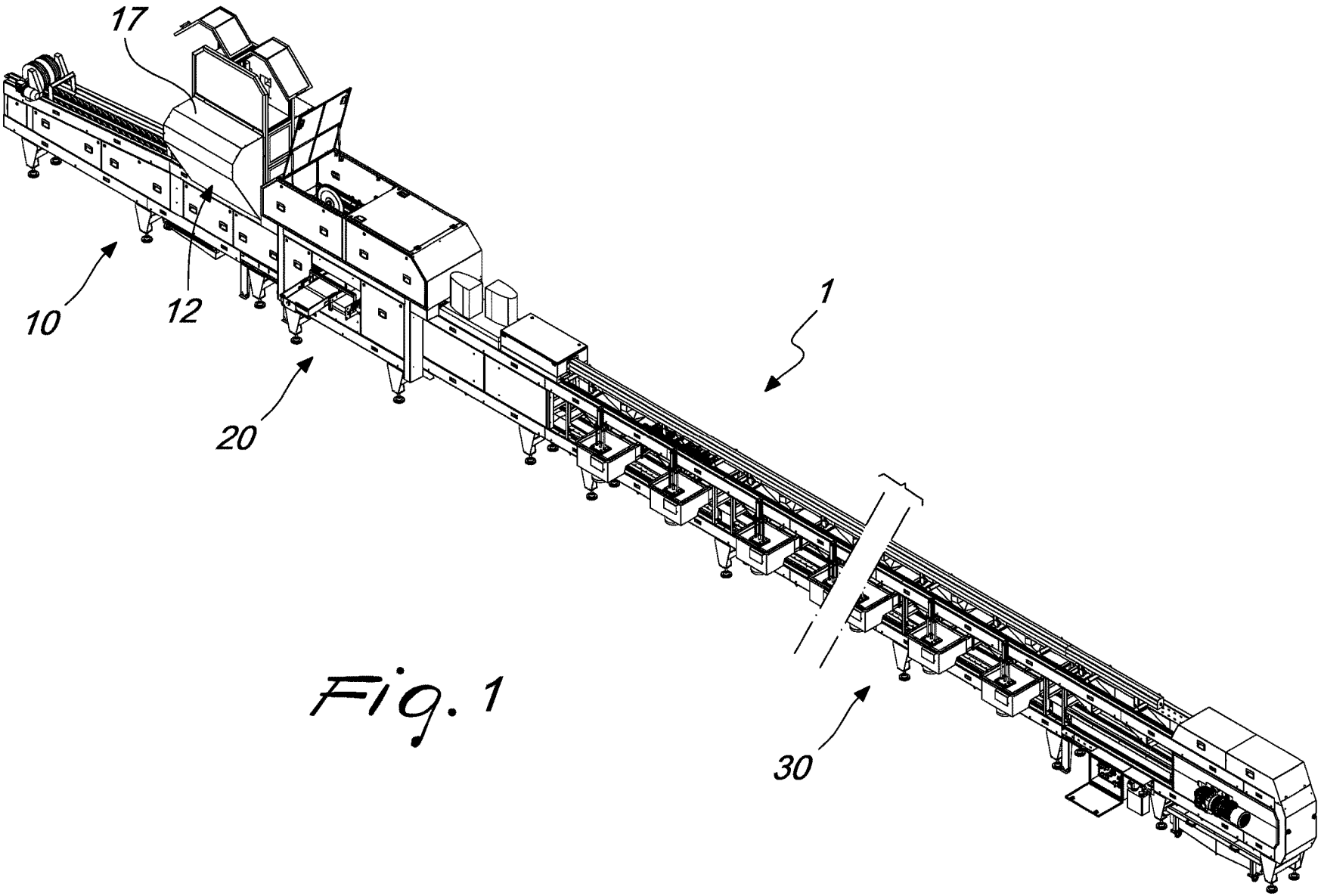
FIG. 1 is a perspective view of the apparatus according to the disclosure.
Figure 2:
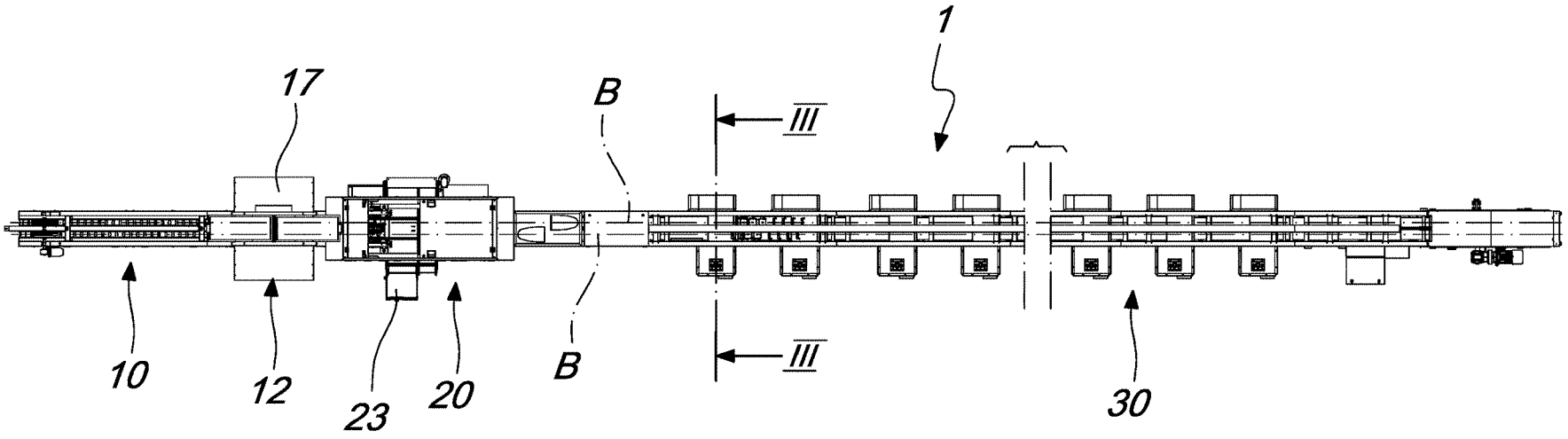
FIG. 2 is a top view of the apparatus of FIG. 1.
Figure 3:
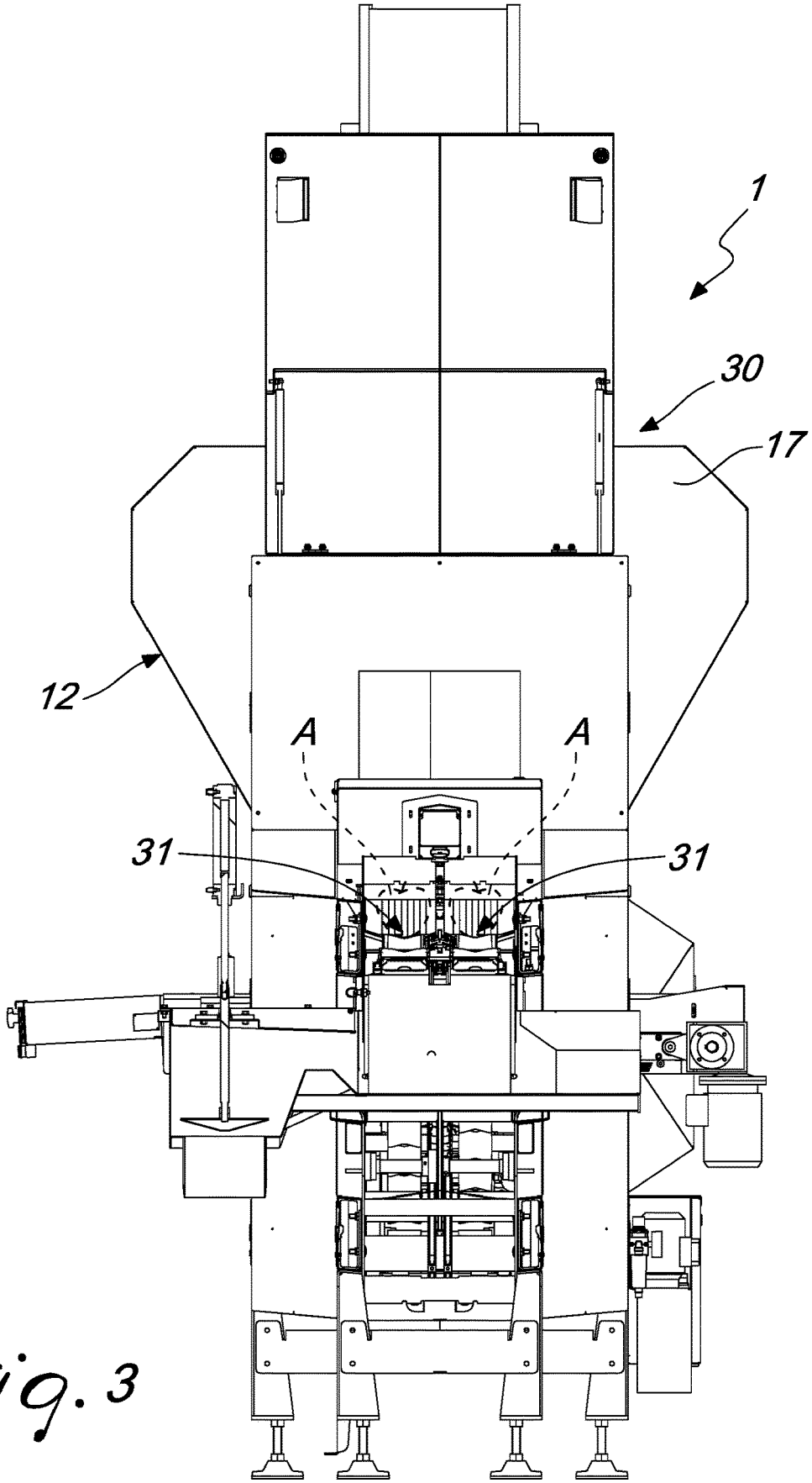
FIG. 3 is a sectional view of FIG. 2, taken along the line III-III.

With reference to the figures, an apparatus for treating horticultural products A (which for the sake of simplicity are shown only in some figures in dashes) is generally designated by the reference numeral 1.

In this regard, it is specified that in the preferred application of the disclosure the horticultural products A are apples, which are usually fed to the apparatus 1 in a substantially unsorted manner (often, just as they have been harvested from the fields) and therefore with a great heterogeneity in terms of dimensions, color, defectiveness, cleanliness, degree of ripeness, et cetera.

The typical aim of the apparatus 1 is indeed to sort and divide the apples into homogeneous subgroups.

It is useful to point out, in any case, that use of the apparatus 1 according to the disclosure for other types of treatment and/or for other fruits or horticultural products A in general is not excluded, without thereby abandoning the protective scope claimed herein. More generally, therefore, where reference shall be made specifically to apples in the pages that follow, the teachings described therein must be understood to be extended to any other horticultural product A.

The apparatus 1 comprises in series at least one first station 10, at least one second station 20 and at least one third station 30, crossed in sequence by the horticultural products A, which are thus subjected to the treatments and/or checks to which each station 10, 20, 30 is assigned. It is specified, moreover, that although the accompanying figures show an apparatus 1 that has only the three stations 10, 20, 30, it is not excluded that the apparatus 1 might be provided with further stations, be they upstream, downstream or intermediate in relation to the three just mentioned.

The first station 10, which as mentioned can be fed directly and in an unsorted manner with apples that have just been harvested from the fields, comprises first elements 11 for the individual handling of respective horticultural products A (each first element 11 is thus capable of transferring at most one single horticultural product A).

Since each apple is provided to a respective first element 11, upstream of the first station 10 there is a separator device, even of a known type, capable indeed of receiving masses of apples and providing them one by one to respective first elements 11.

Moreover, the first station 10 comprises at least one vision system 12 (a video camera or a set of video cameras, for example, associated with respective image processing software), controlled by an electronic control and management unit (a controller, a computer, a personal computer, or others).

By means of the vision system 12, therefore, the electronic unit can acquire information related to at least one parameter of interest of each horticultural product A (in transit along the first station 10).

In this regard, it is specified that the parameters acquired can be multiple, selected for example (but not exclusively) among dimensions, shape, color, degree of ripeness and/or presence of defects (superficial or internal), or others.

In series to the first station 10 (downstream of the latter), the apparatus 1 then has a second station 20, which comprises in turn second elements 21 for the individual handling of respective horticultural products A (received, directly or indirectly, from the first elements 11). Each second element 21 is thus also capable of transferring at most one single horticultural product A.

Furthermore, the second station 20 comprises at least one device for weighing each horticultural product A in transit.

Like the vision system 12, the weighing device also can be of any type, and therefore even chosen among those normally used in the sector for this purpose.

Furthermore, and again like the vision system 12, the weighing device also is controlled by the electronic unit mentioned above, so as to provide the latter with the data item related to the actual weight of each apple.

In series to the first station 10 and to the second station 20, and downstream of the latter, the apparatus 1 provides for a third station 30. The third station 30 comprises third elements 31 for the individual handling of respective horticultural products A (received, directly or indirectly, from the second elements 21). Again, therefore, each third element 31 also is capable of transferring at most one single horticultural product A.

The third station 30 further comprises means 32 for selective conveyance of each horticultural product A in transit toward one of at least two collection areas (where a respective basket or other container can be arranged). The means 32 can thus be actuated by the electronic unit to sort the horticultural products A into at least two corresponding homogeneous subgroups (each of which accumulates in a respective area) as a function of the information acquired by the vision system 12 and/or by the weighing device.

So far, it is specified that the apparatus 1 (in particular with its stations 10, 20, 30 in series) can be considered as being of a substantially traditional type, and ensures the sorting into different homogeneous subgroups of a mass of apples (or other horticultural products A) supplied in an unsorted manner.

In fact, by virtue of the information acquired by the vision system 12 and/or by the weighing device (again according to per se known manners), the electronic unit controls the means 32 as a function of a preset classification criterion (which can also be reprogrammed at will).

More precisely, by cross-referencing the data collected with the range of parameters assigned preliminarily to each collection area, the electronic unit identifies, for each horticultural product A in transit, the most appropriate destination and activates accordingly the means 32, which therefore send to each area all and only the apples that are within the range of parameters assigned thereto.

After being sorted into uniform subgroups, the apples can of course be stored, sent to packaging or subjected to further treatments.

Figure 11:
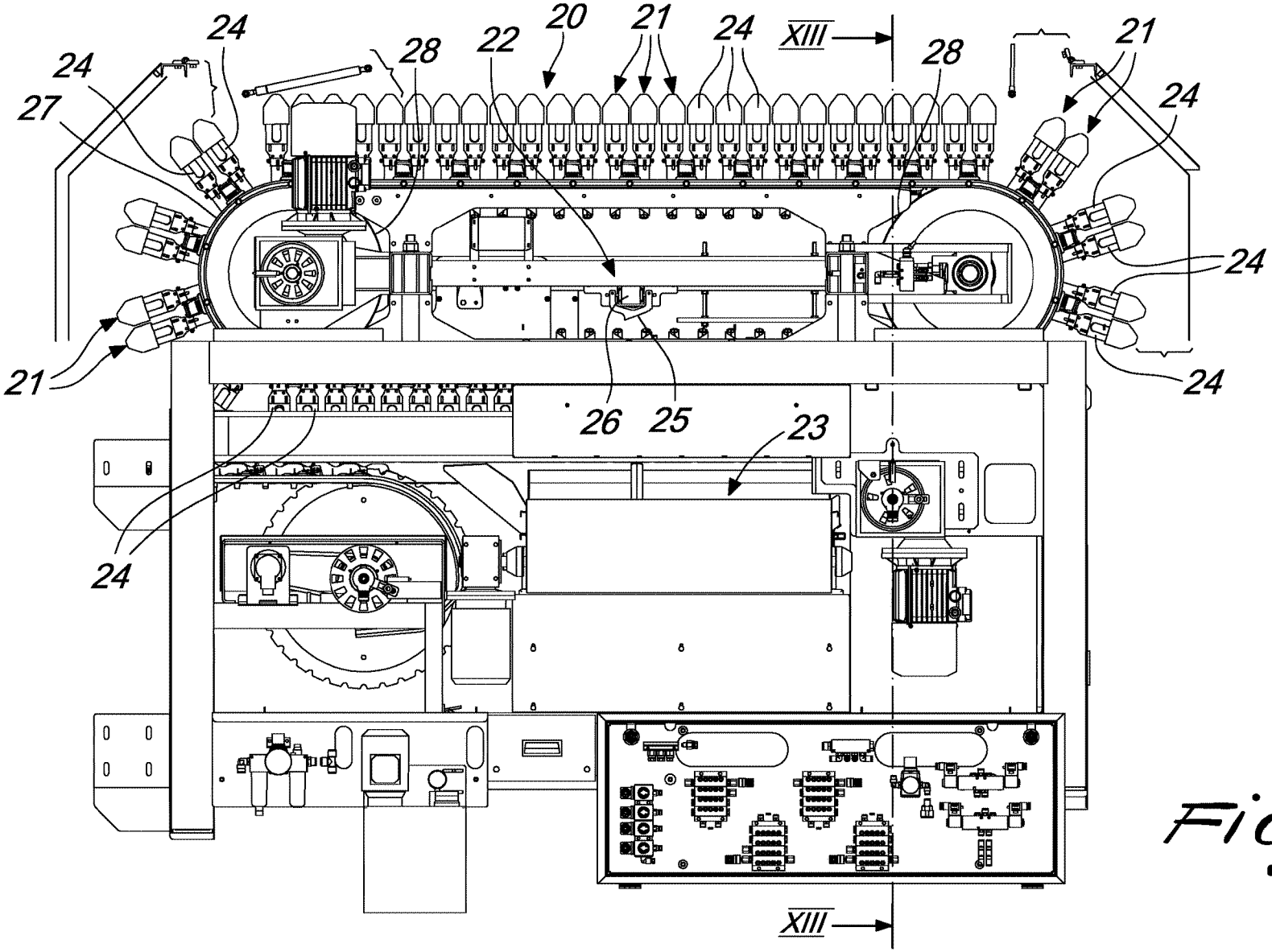
FIG. 11 is a sectional view, taken along a longitudinal plane, of the second station of the apparatus of FIG. 1.
Figure 12:
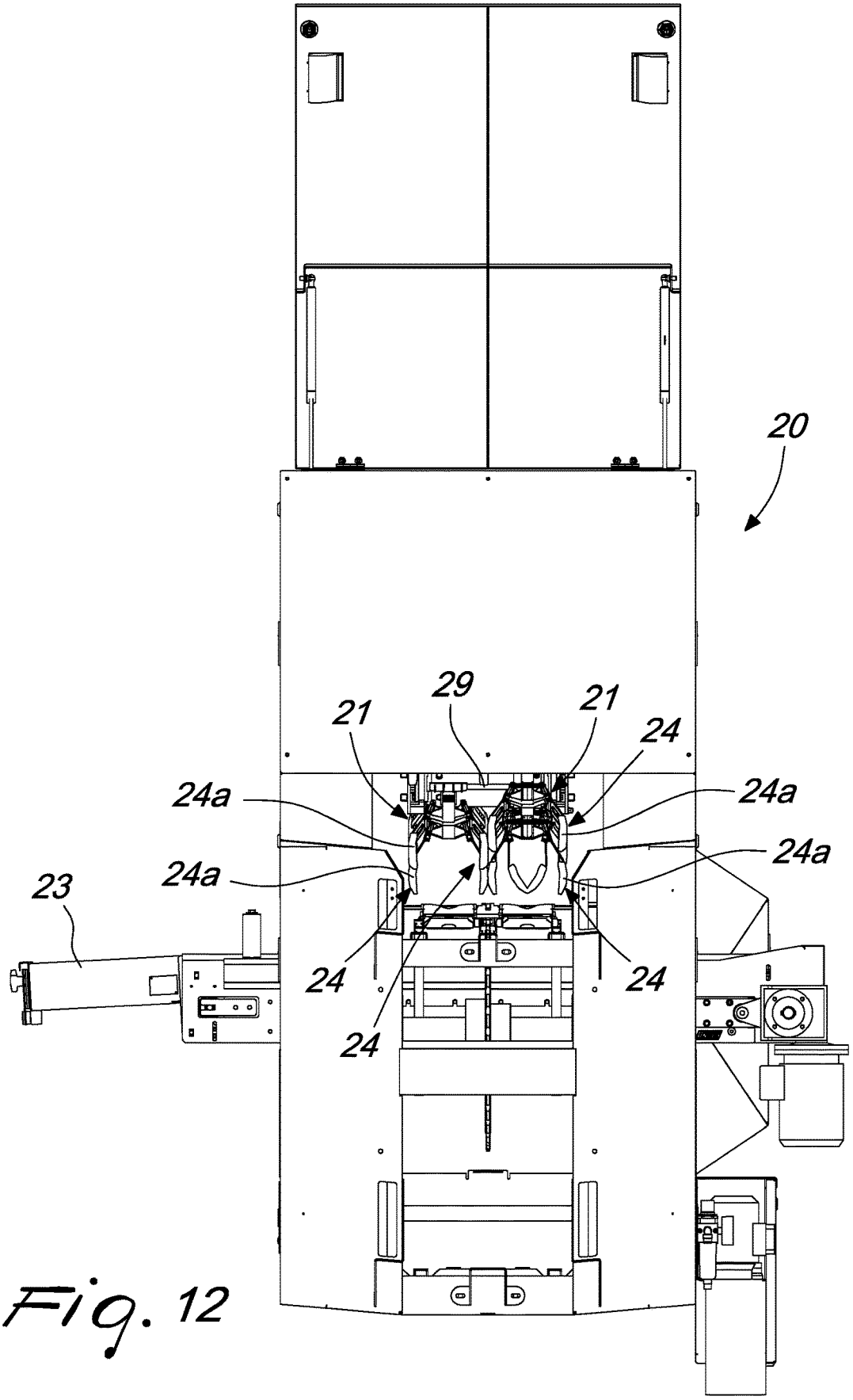
FIG. 12 is a front view of the second station of the apparatus of FIG. 1.
Figure 13:
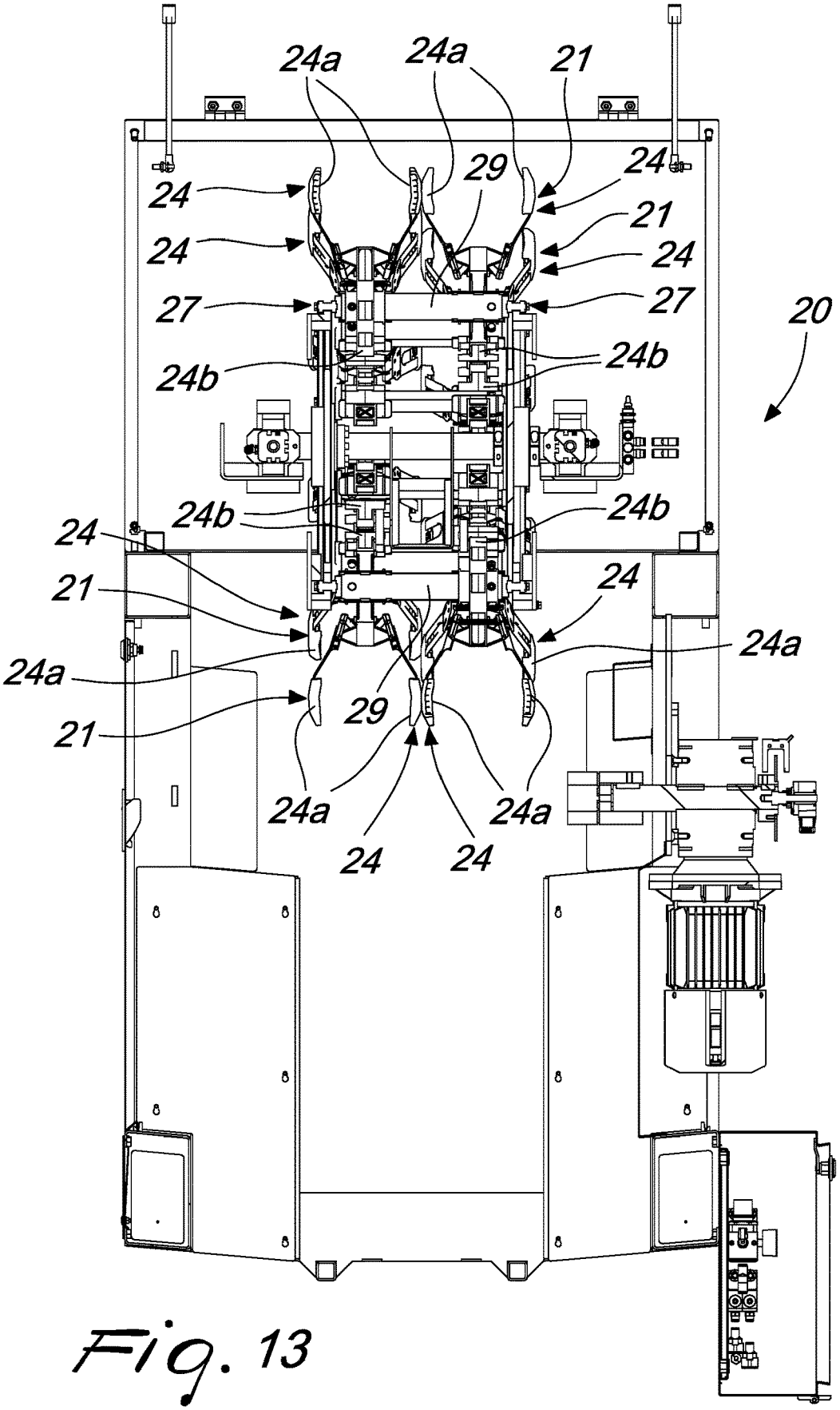
FIG. 13 is a sectional view of FIG. 11, taken along the line XIII-XIII.
Figure 14:
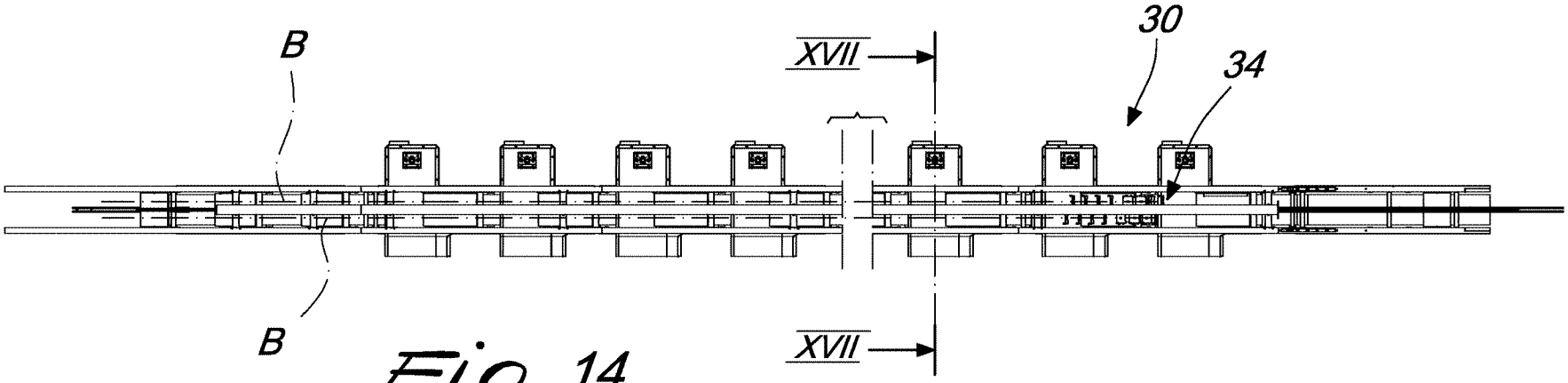
FIG. 14 is a top view of the third station of the apparatus of FIG. 1.
Figure 15:
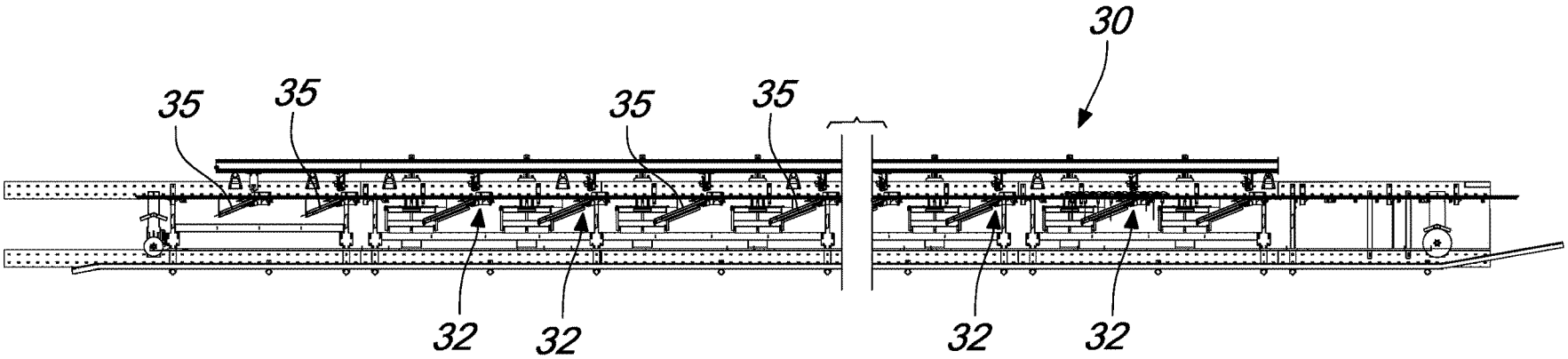
FIG. 15 is a side elevation view of the third station of the apparatus of FIG. 1 without some components.

According to the disclosure, the second station 20 comprises an intermediate unloading assembly 22 (FIG. 11), which can be actuated selectively by the electronic unit to command the release of the horticultural products A, while they are moved by the second elements 21.

In practice, therefore, the assembly 22 ensures the achievement of the intended aim, since its arrangement along the second station 20, upstream of the third station 30 that accommodates the means 32 designed for final sorting of the apples, offers practical methods of early evacuation of the products A in transit. Evacuation can in fact be controlled by the electronic unit, which as shown has the information acquired by the vision system 12 and/or by the weighing device.

In particular, and for each horticultural product A in transit in the second station 20, the electronic unit is configured at least to control the match between a preset parameter and the corresponding data item acquired by one between the vision system 12 and the weighing device. Although different mutual arrangements are not excluded, indeed to allow checking also of the weight, the weighing device is appropriately arranged upstream of the assembly 22 proper, so that the electronic unit already has said data item available at said assembly.

Furthermore, the electronic unit is configured for the timely actuation of the assembly 22 when said match occurs.

By choosing therefore beforehand the parameter of interest (which can therefore be related to the degree of ripeness, shape and dimensions, color, weight, or others), it is possible to set up the apparatus 1 so that when a match occurs between the data item acquired for the apple in transit and said parameter (for example, size below a certain value, or weight exceeding a certain threshold), the electronic unit actuates automatically the assembly 22, causing the early unloading of the fruit, preventing it from continuing toward the third station 30 (and being instead collected in a separate tub 23, which is arranged below the assembly 22).

In the preferred application, mentioned by way of nonlimiting example of the application of the disclosure, the parameter is chosen so as to indicate the rotting of the horticultural product A in transit (information which, as known, can be obtained by analyzing with infrared spectrographic methods the products A proper at the vision system 12).

Thus, the apparatus 1 ensures the early segregation of rotten apples, preventing them, by continuing in their path, from being able to contaminate other fruits or the mechanisms assigned to their movement handling.

With further reference to the preferred constructive solution, and in particular to FIGS. 9 to 13, each second element 21 comprises a grip clamp 24, provided with respective arms 24*a* (indicated for the sake of simplicity only in FIGS. 12 and 13) which can move between an active configuration and a passive configuration.

In the active configuration, normally assumed during transit from the immediate vicinity of the first station 10 to the vicinity of the third station 30, the arms 24*a* are kept clamped on a respective horticultural product A for its transfer along the second station 20. Vice versa, in the passive configuration, normally assumed in the return stroke, the arms 24*a* are kept mutually spaced.

Each clamp 24 is provided with a button 24*b* for actuating the transition from the active configuration to the passive configuration. Said button 24*b* (FIG. 13) can be of a known type, and according to equally well-established methods it can be arranged at the top of the clamp 24 (on the opposite side with respect to the free ends of the arms 24*a*), being associated with a mechanism that is normally arranged so as to interfere with the action of elastic elements the coupling reaction of which is oriented so as to open the arms 24*a*.

At a terminal area of the second station 20, which is proximate to the third station 30, there is furthermore a fixed body for affecting the button 24*b* (each button 24*b*).

This ensures the automatic delivery (by gravity) of each horticultural product A in transit to the third elements 31. In fact, by choosing appropriately the placement of the fixed body, arranged along the path traced by each button 24*b*, it is possible to impose the automatic actuation of each one of them (upon reaching said terminal area of the second portions) and therefore the transition to the passive configuration for the arms 24*a*, with consequent release of the apples conveyed up to that point.

Obviously, on the opposite side the closure of the arms 24*a*, and therefore the transition from the passive configuration to the active configuration in order to be able to grip a new apple, conveyed up to that point by the first elements 11, is actuated.

It is useful now to specify that the weighing device also can be chosen among the many of the known type and therefore can be straightforward to implement in practice for the person skilled in the art (as already occurs, besides, for the vision system 12). Mention is made, therefore, of the possibility that each clamp 24 can be raised temporarily with respect to the vertical height at which it advances in its motion toward the third station 30. Due to this rise, the clamp 24 bears temporarily on the respective support only with its own weight (which is known) and the weight of the conveyed apple. During the rise, the clamp 24 is weighed by a load cell (or other device) in order to obtain the desired data item related to the weight of the apple.

In an embodiment of considerable practical interest, described by way of nonlimiting example of the application of the disclosure, the assembly 22 comprises a movable body 25 for affecting the buttons 24*b* (FIG. 11), which is arranged upstream of the fixed body and can be actuated selectively for reversible transition from an inactive position to an active position.

In the inactive position, the movable body 25 does not interfere with the transition of the buttons 24*b*, while in the active position it is arranged so as to affect them. In the active position, therefore, the movable body 25 causes the transition of the arms 24*a* from the active configuration to the passive configuration and the consequent early release of the horticultural products A, upstream of the third station 30 (indeed to prevent them from being delivered to the third elements 31 and making them instead fall into the tub 23).

With further reference to this embodiment, the unloading assembly 22 comprises an actuator 26 for actuating the movable body 25, which can be activated selectively by the electronic unit, and the movable body 25 is in turn constituted substantially by a profiled cam. Said cam oscillates therefore between the active position, in which a useful profile thereof is arranged so as to affect the buttons 24*b*, and the passive position, in which it does not interfere with their transition.

Advantageously, in order to increase the productivity of the entire apparatus 1, the first elements 11, the second elements 21 and the third elements 31 are arranged so that they are offset along two respective side-by-side trajectories B for the advancement of the horticultural products A (the trajectories B are shown only in some figures for the sake of simplicity).

Due to the offset, in each station 10, 20, 30 each element 11, 21, 31, which can move along one of the two trajectories B, is therefore misaligned transversely with respect to the corresponding elements 11, 21, 31, which can move along the other trajectory B.

Figure 4:
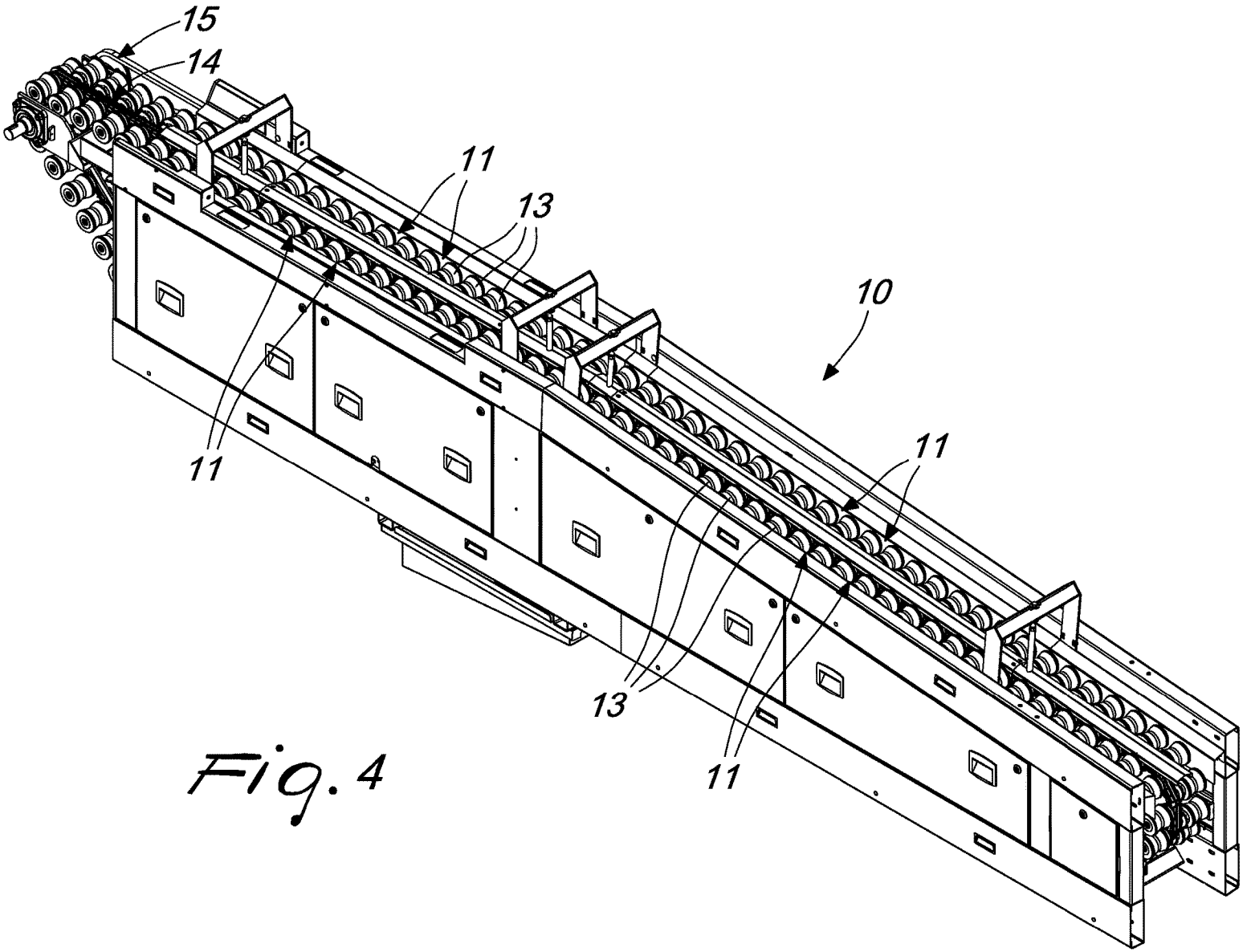
FIG. 4 is a perspective view of the first station of the apparatus of FIG. 1, without the vision system.
Figure 5:
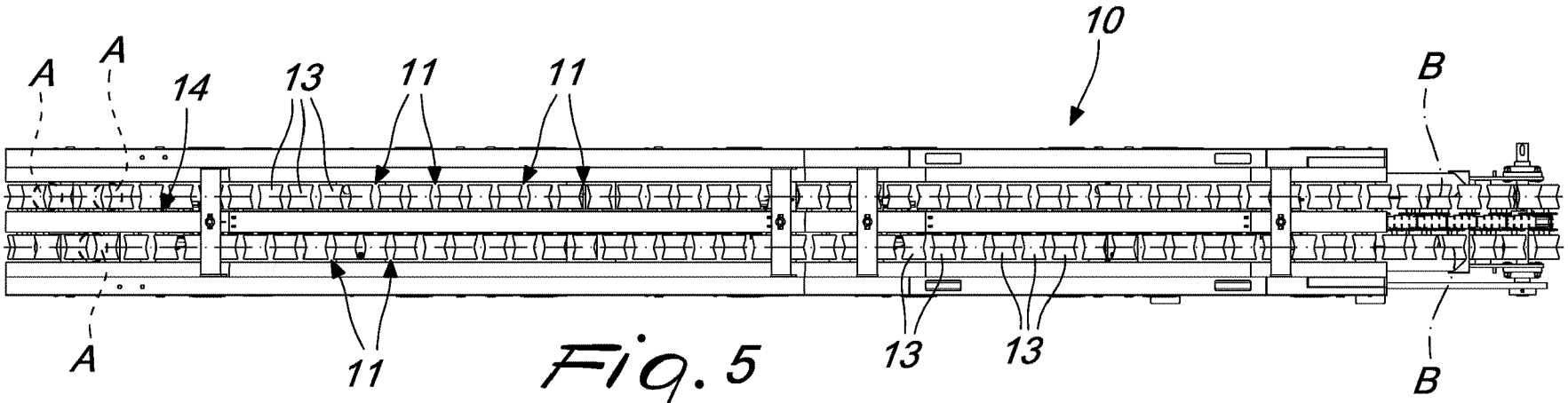
FIG. 5 is a top view of the first station of the apparatus of FIG. 1, without the vision system.
Figure 6:
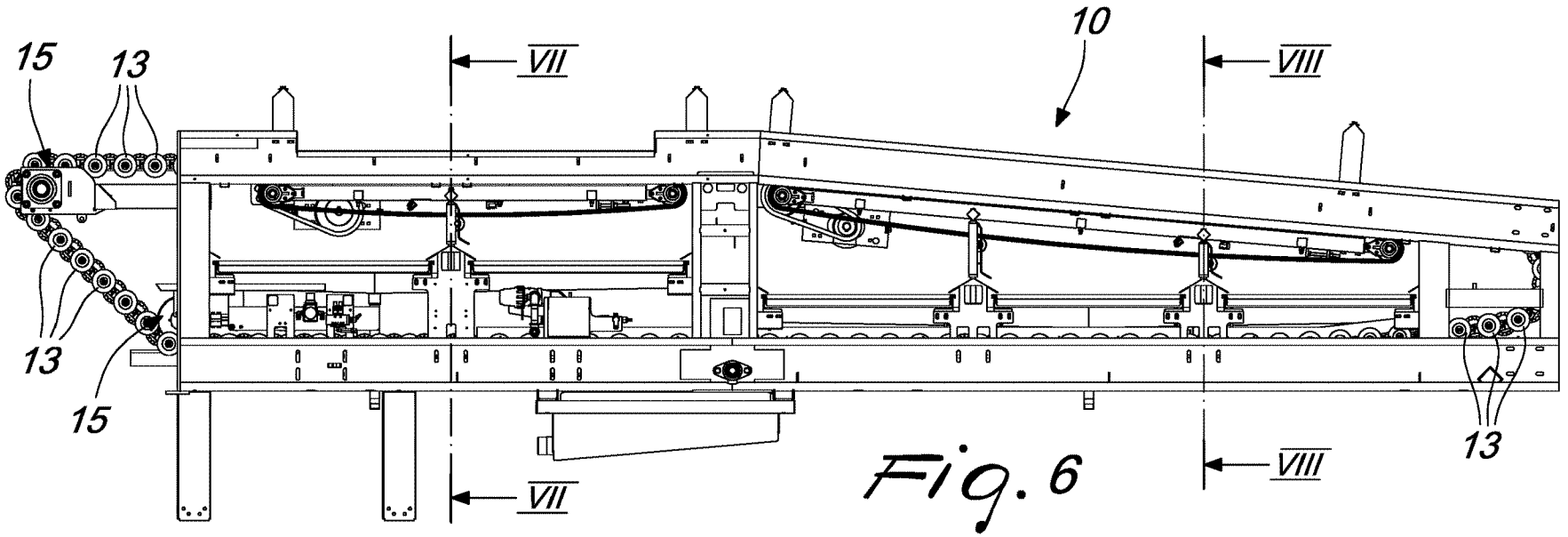
FIG. 6 is a side elevation view of the first station of the apparatus of FIG. 1, without the vision system.

This offset is clearly visible for example in FIGS. 4 and 5 (for the first elements 11), 9, 10 and 11 (for the second elements 21) and 14, 16 and 18 (for the third elements 31).

It should be noted, therefore, that the choice to arrange the elements 11, 21, 31 so that they are offset, and thus move in a row along two lines which are parallel but are constantly mutually misaligned, ensures important benefits to the apparatus 1 according to the disclosure. First of all, in fact, with respect to lines of the known type (in which the apples move in a row along the same trajectory), the productivity of the apparatus 1 is obviously doubled, without having to act on the various active mechanisms and therefore even accepting their inherent speed limitations.

At the same time, the offset allows to keep the space occupation low (it is not doubled with respect to known lines but only slightly increased). In fact, the structures and the auxiliary devices assigned to correct operation and in particular to the handling of each individual element 11, 21, 31 (as well as any additional devices that perform other functions), by virtue of the offset, do not have to be necessarily arranged side by side (which would render the overall space occupation excessive), but can at least partially follow one another in an alternated manner along the direction defined by the trajectories B (each laterally adjacent to the respective element 11, 21, 31), reducing significantly the center distance required between said two trajectories B (and the two rows of elements 11, 21, 31 that move along them).

In the preferred embodiment, proposed by way of non-limiting example of the application of the disclosure (FIGS. 4 to 8), each first element 11 can move cyclically along a first partial portion of one of the trajectories B and comprises at least one pair of rollers 13. In each pair, the rollers 13 are arranged mutually close with a substantially horizontal longitudinal axis that is perpendicular to the first portion, in order to constitute jointly a resting element for a respective horticultural product A.

Figure 7:
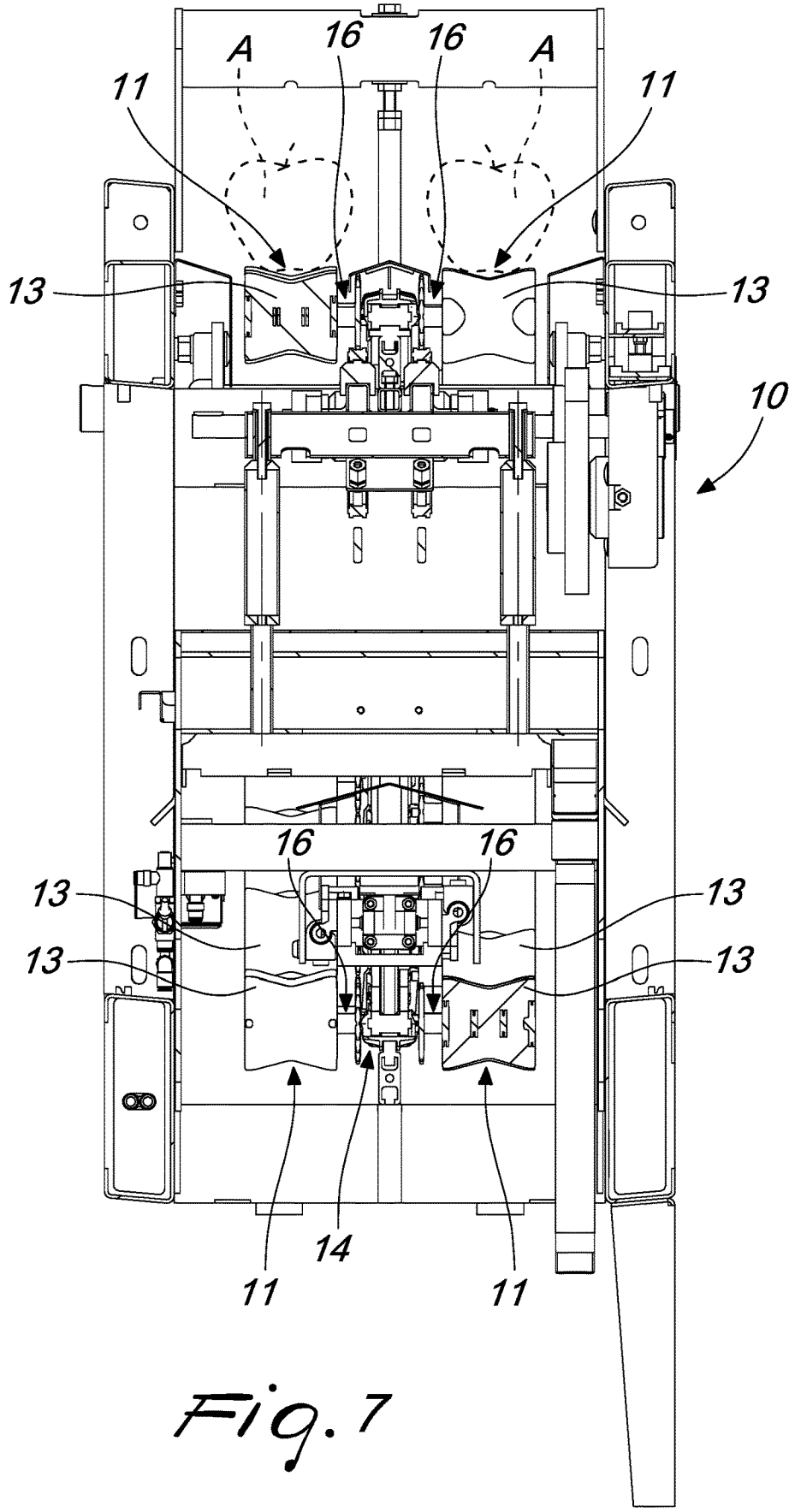
FIG. 7 is a sectional view of FIG. 6, taken along the line VII-VII.
Figure 8:
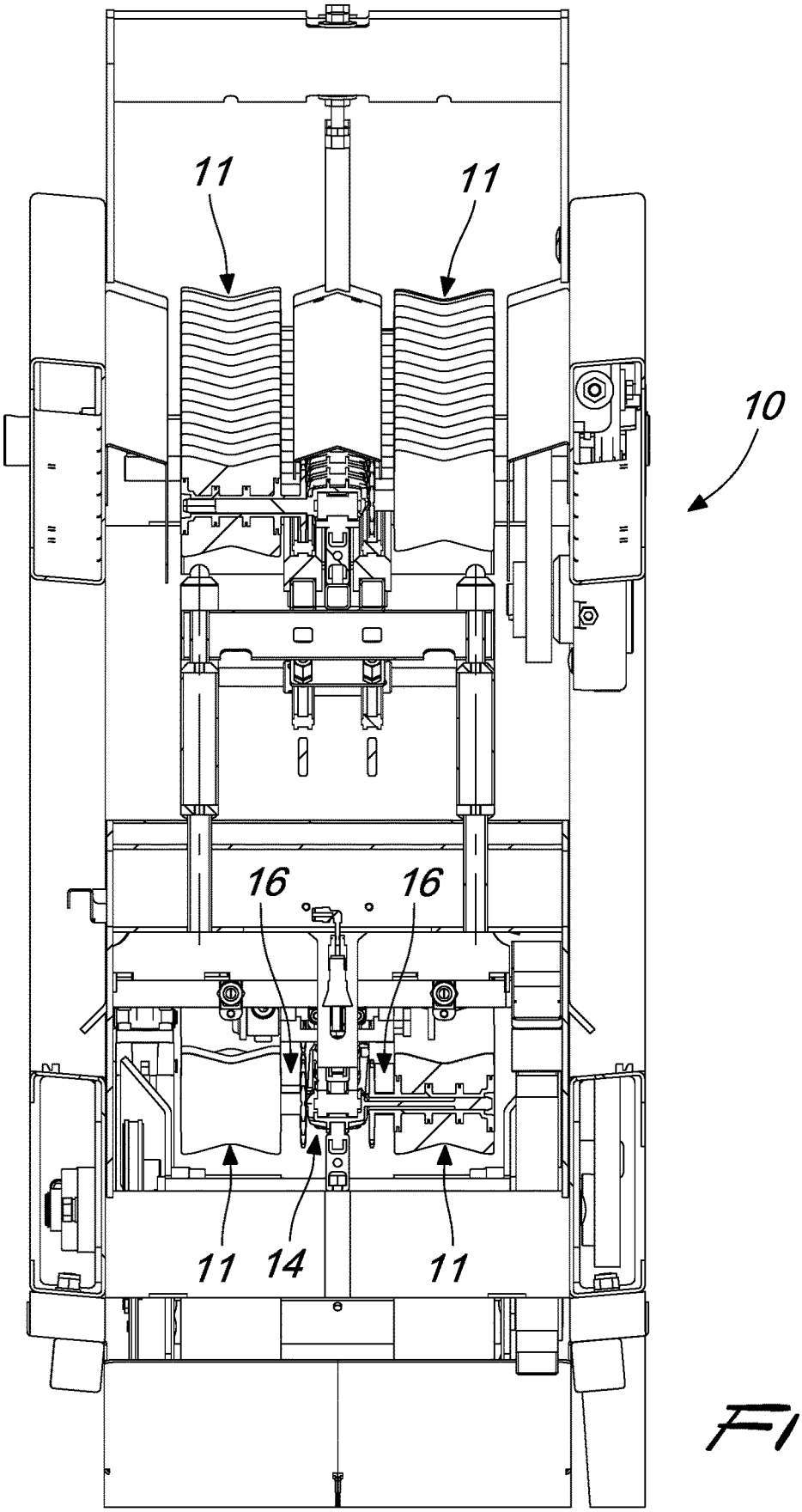
FIG. 8 is a sectional view of FIG. 6, taken along the line VIII-VIII.
Figure 9:
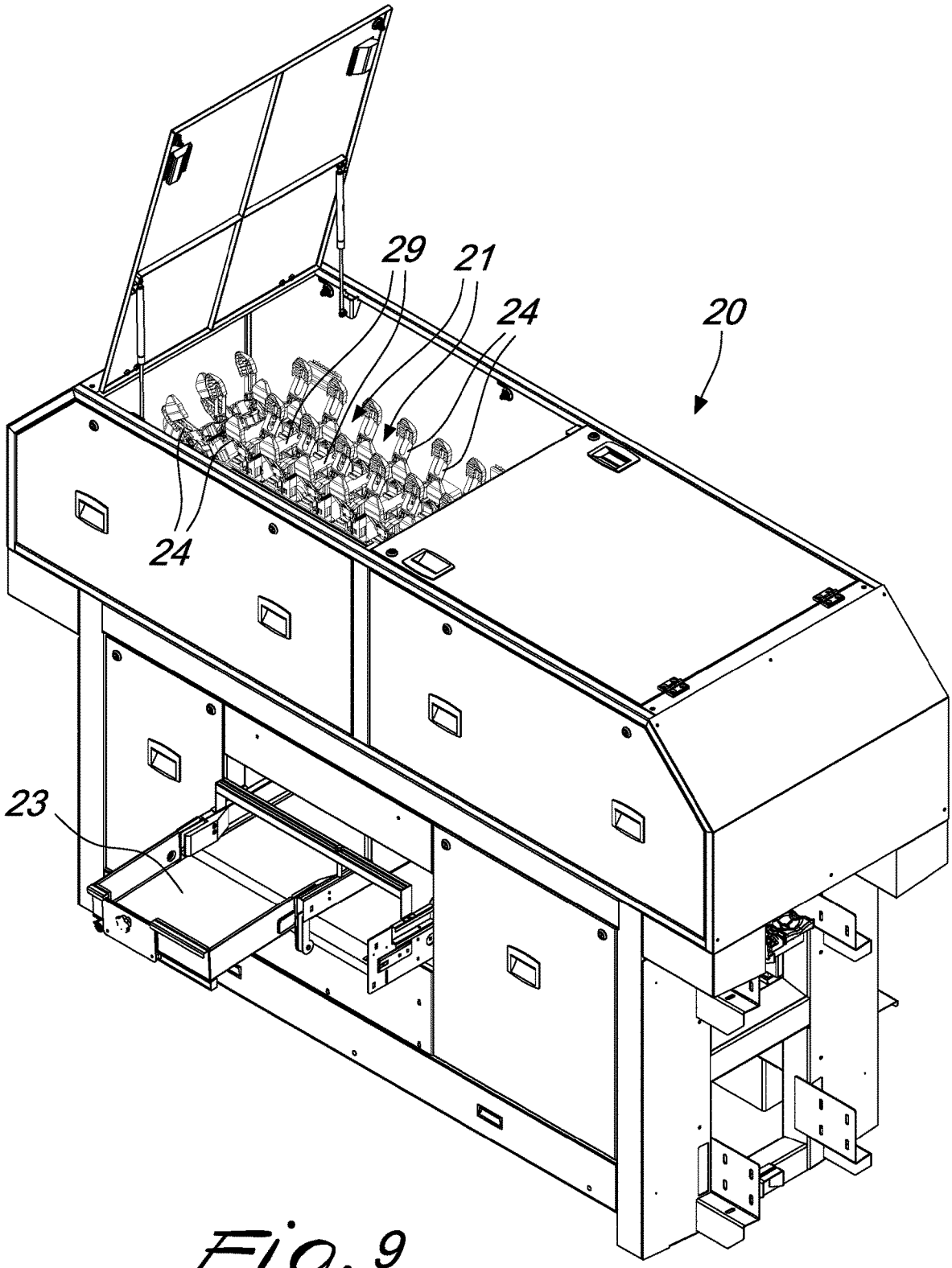
FIGS. 9 and 10 are perspective views from opposite sides of the second station of the apparatus of FIG. 1 with some covering housings opened to show the second elements.
Figure 10:
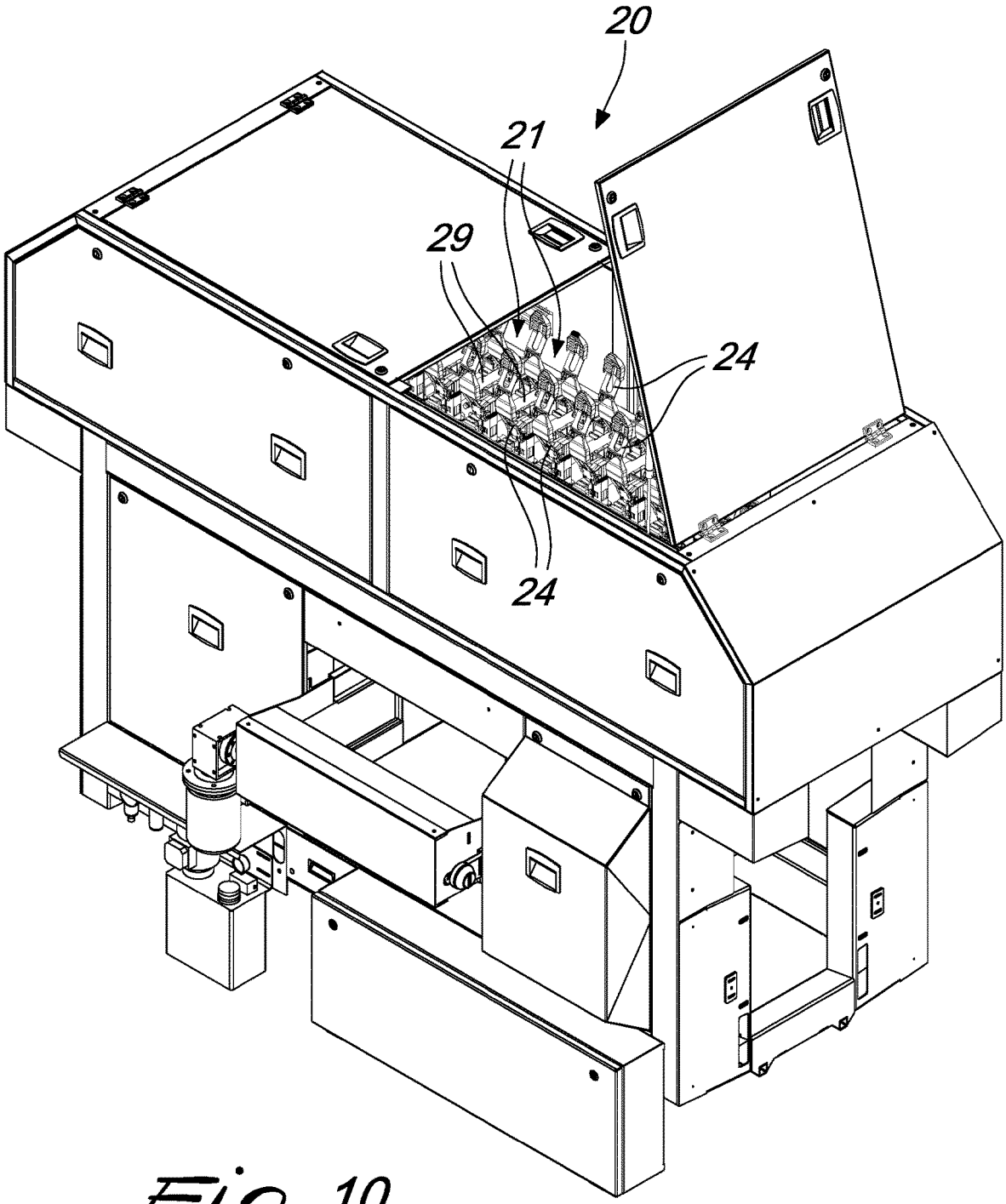

In greater detail, as is evident for example from FIG. 7, each roller 13 has an axially symmetrical extension and has, in its central region, a concavity, defined by a cross-sectional narrowing. Each apple rests stably on the lateral surface of two consecutive rollers 13, exactly at their concavities. The possibility is not excluded, however, to give a different shape to the rollers 13 or to provide, for each element 11, two parallel rows of rollers 13, for example having a flattened shape (like discs) and with variable transverse cross-section, which operate jointly like two single rollers 13 of the accompanying figures.

Each roller 13 is moved by a respective first traction apparatus along a first closed path, which forms with one of its parts a corresponding first portion and can comprise for example a first belt 14, interposed between the laterally adjacent rows of rollers 13 and wound around two or more first pulleys 15. Each roller 13 is moved along the respective first closed path by a respective first support 16, which is coupled to the first belt 14. By virtue of the offset arrangement, the first supports 16 are arranged in sequence and alternately between the rollers 13, occupying a reduced amount of space since they are not mutually laterally adjacent but also are, in practice, arranged in a row.

Usefully, the vision system 12 is placed inside a tunnel 17 that is crossed by the first portions of the laterally adjacent trajectories B, so as to ensure the acquisition of the information related to the parameter of interest of each horticultural product A in low-brightness conditions. The low brightness is useful for optimal operation of the video cameras (too much light might compromise correct image acquisition). Moreover, this allows to ensure uniform brightness conditions over time, without being affected by the outside conditions and by the light variations that can occur in the surrounding environment.

It should be noted that in the second station 20 each clamp 24 also can move cyclically along a second partial portion of one of the trajectories B, arranged downstream of the first one, and more precisely it is moved by a respective second traction apparatus along a second closed path, which forms with one of its parts a corresponding second portion.

The second apparatus also can comprise for example at least one second belt 27 (and, for example two, arranged at the sides, as in the accompanying figures), wound around two or more second pulleys 28. In this context, each clamp 24 is moved along the respective second closed path by a respective second support 29, which is coupled to the second belt 27.

By virtue of the offset, the second supports 29 also are arranged in sequence and alternately between said clamps 24, occupying a reduced amount of space since they are not mutually laterally adjacent but are in practice arranged in a row.

With further reference to the preferred constructive solution, and to FIGS. 14 to 18, each third element 31, which in turn can move cyclically along a third partial portion of one of the two trajectories B, arranged downstream of a respective second portion, comprises a tray 33 adapted to support and contain a respective horticultural product A. Each tray 33 is therefore moved by a respective third apparatus for traction along a third closed path, which forms with one of its parts a corresponding third portion of each one of the trajectories B.

In a manner similar to what has been noted for the first and second apparatuses, the third apparatus also can comprise for example a third belt 34 (or a similar traction device), wound around two or more third pulleys. In the solution of the figures shown, a single third belt 34 (with the respective third supports of the trays 33) is interposed between the two rows of staggered trays 33. Once again, therefore, the devices that are part of the third traction apparatus 34 and are responsible for the movement of the trays 33, by virtue of the offset, occupy a reduced amount of space, allowing to contain overall space occupation.

Figure 16:
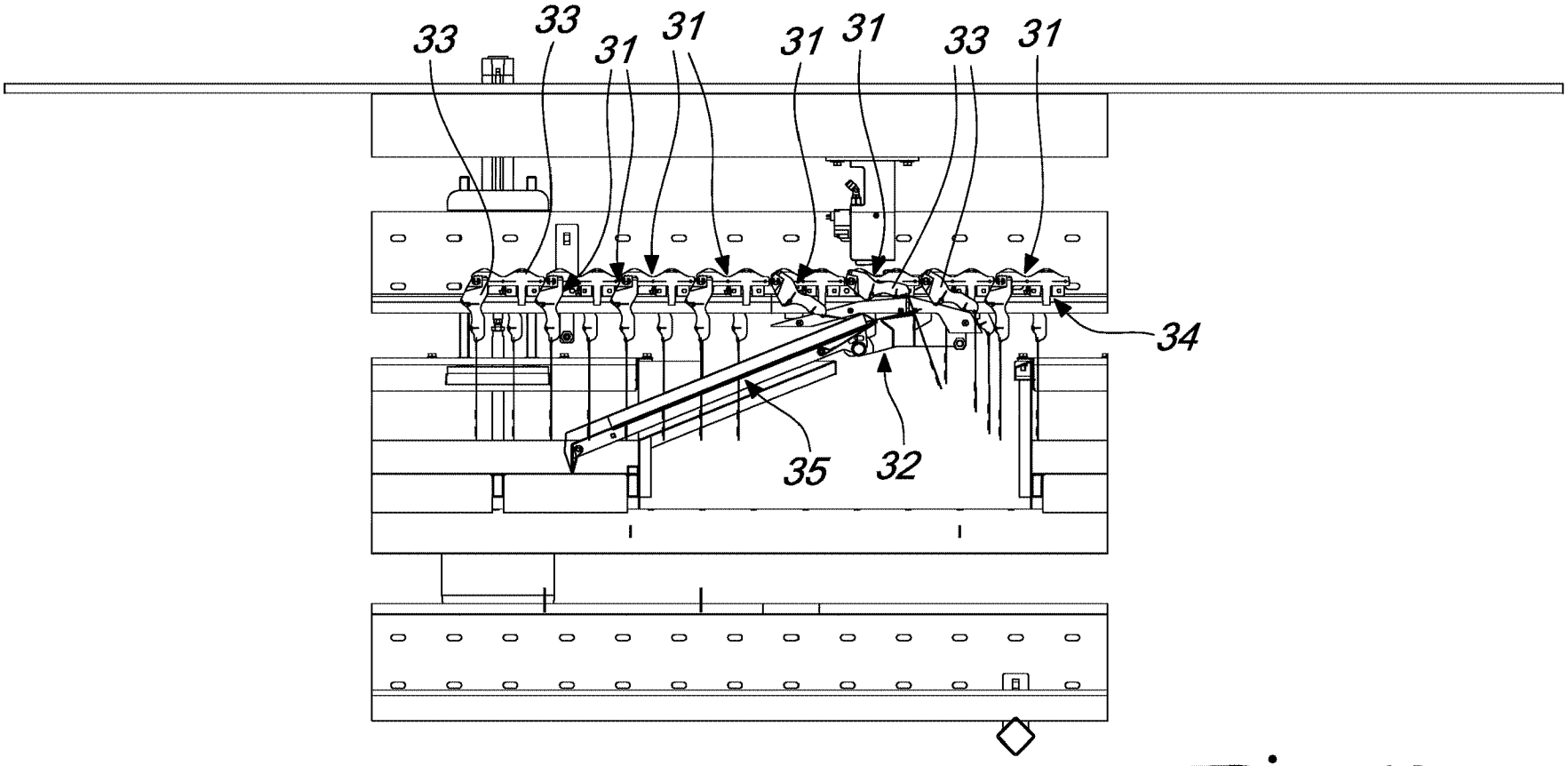
FIG. 16 is a side elevation view of a detail of the third station of the apparatus of FIG. 1.
Figure 17:
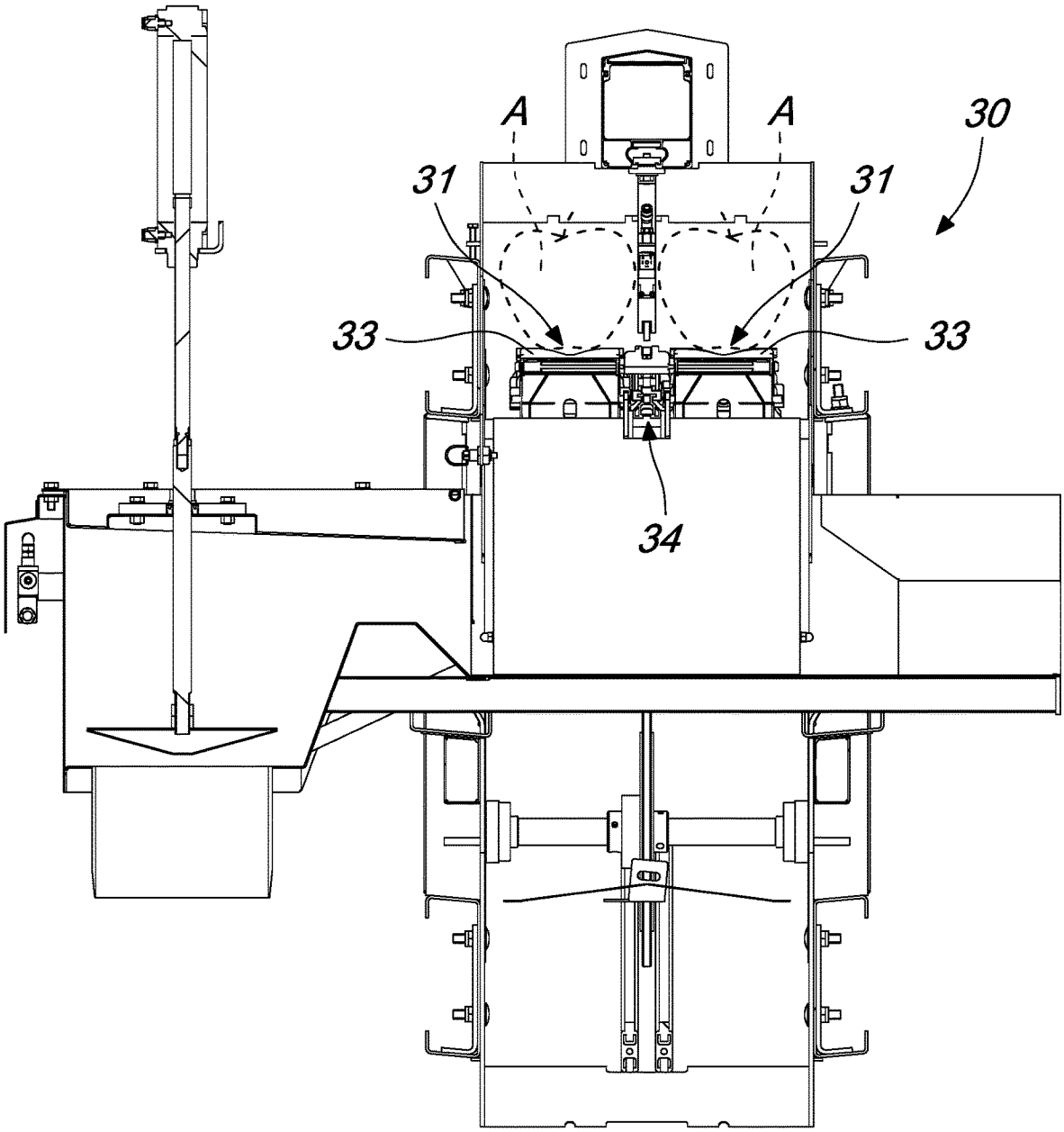
FIG. 17 is a sectional view of FIG. 14, taken along the line XVII-XVII.
Figure 18:
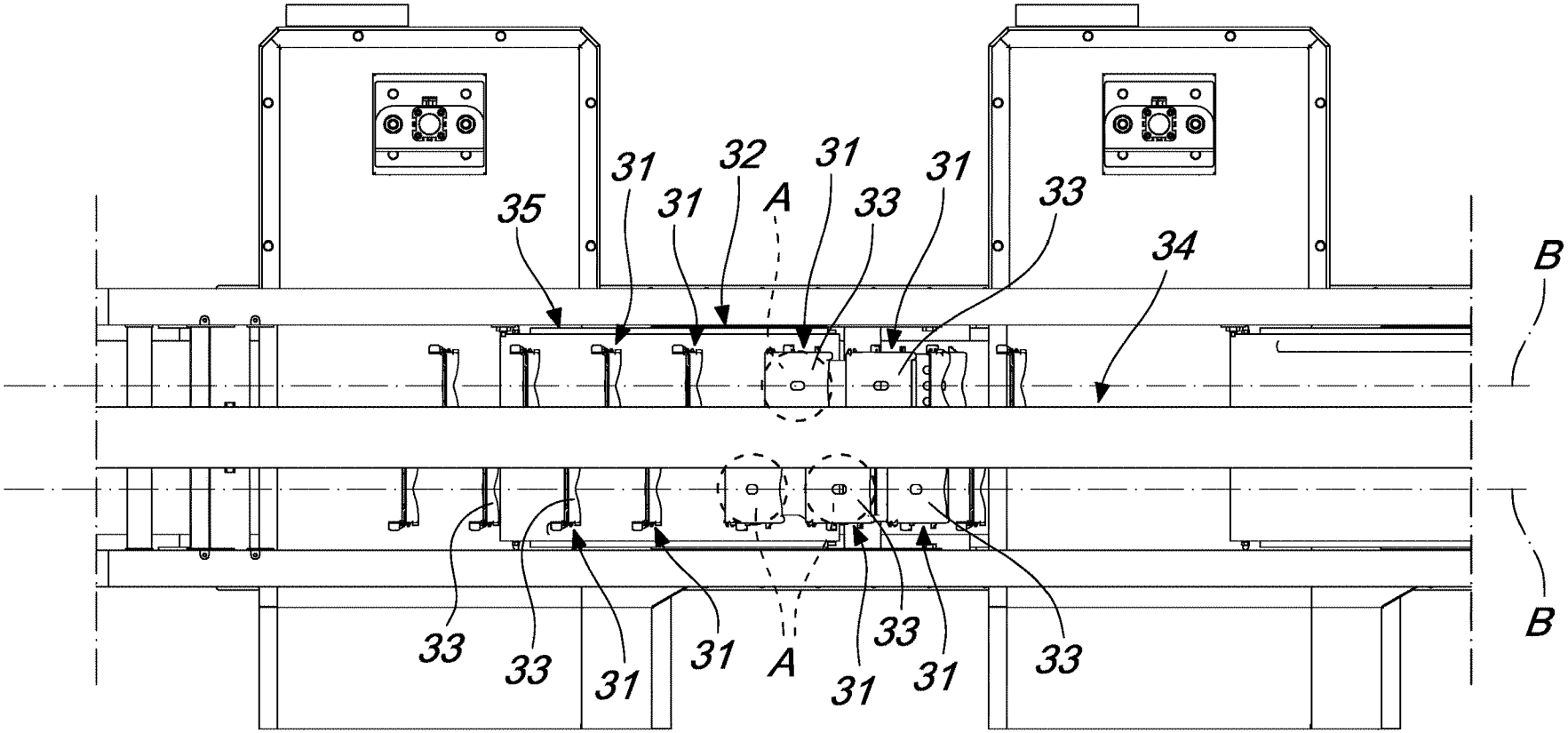
FIG. 18 is a highly enlarged view of a detail of FIG. 14.

Usefully, and as can be deduced in particular from FIGS. 16 and 18, each tray 33 can rotate at least partially about a main axis that is transverse to the corresponding third portion. For each tray 33, this allows its temporary transition, actuated by the means 32, from a substantially horizontal arrangement, in which the respective horticultural product A is normally conveyed along the corresponding third portion, to an inclined (or even vertical) arrangement, for the release of the corresponding horticultural product A toward one of the collection areas.

It should be noted that multiple chutes 35, which lead to respective collection areas, are preferably arranged along the third station 30.

When the means 32 actuate the rotation of a tray 33 from the horizontal arrangement to the inclined arrangement (per se according to known methods), the apple A that up to that point had been conveyed by the tray 33 falls or rolls by gravity toward the chute 35, which conveys it toward the designated collection area.

The electronic control and management unit can therefore actuate the rotation of each tray 33 at selectively one of the chutes 35, indeed to sort into homogeneous subgroups (gathered in the respective collection areas) the entire mass of apples supplied initially to the first station 10.

The operation of the apparatus 1 according to the disclosure, and the methods with which it achieves the intended aims, have therefore already been described.

It has in fact already been shown that extremely heterogeneous apples are supplied to the first station 10 and are rested stably on the first elements 11 (consecutive pairs of rollers 13), which move in an offset arrangement along the first portion of side-by-side trajectories B (which are rectilinear or even curvilinear).

After being analyzed by the vision system 12, which detects one or more parameters of interest providing them to the control and management unit, at the end of the first portion of the trajectories B the apples are gripped by the second elements 21 (the clamps 24), which move in an offset arrangement along the second portion of the laterally adjacent trajectories B.

While the apples travel along the second portion, they are weighed and the related data item is also provided to the electronic control and management unit.

At the third station 30 the products A are deposited on corresponding third elements 31 (the trays 33), which move in an offset manner along the third portion of the laterally adjacent trajectories B. While they travel along the third portion, the means 32, actuated by the electronic control and management unit, make each apple fall along the chute 35 that leads to the desired collection area.

However, before reaching the third station 30, each apple transits within the field of action of the intermediate unloading assembly 22, which can be actuated by the electronic unit to force the fall of all and only the apples that are deemed unsuitable to continue, or that in any case one wishes to sort in advance. The assembly 22 therefore allows to achieve the intended primary aim and, in greater detail, allows to identify and segregate in advance and in a timely manner all and only the apples that match a preset parameter (and for example, therefore, the rotten ones, preventing them from contaminating the healthy ones).

The presence of the assembly 22 is therefore of unquestionable practical interest, since it offers a further functionality to the apparatus 1, which distinguishes it from those of the known type.

Furthermore, as already noted, the choice to arrange the first elements 11, the second elements 21 and the third elements 31 so that they are offset allows to double the number of apples that circulate in the unit time, and therefore the productivity, without affecting significantly the overall space occupation, which therefore remains modest.

The disclosure thus conceived is susceptible of numerous modifications and variations, all of which are within the scope of the appended claims; all the details may further be replaced with other technically equivalent elements.

In the exemplary embodiments shown, individual characteristics, given in relation to specific examples, may actually be replaced with other different characteristics that exist in other exemplary embodiments.

In practice, the materials used, as well as the dimensions, may be any according to the requirements and the state of the art.

The disclosures in Italian Patent Application no. 102017000052580, from which this application claims priority, are incorporated herein by reference.

The invention claimed is:

1. An apparatus for treating horticultural products, comprising in series at least:

a first station comprising first elements for an individual handling of respective horticultural products and at least one vision system, controlled by an electronic control and management unit, for the acquisition of information related to at least one parameter of interest of each horticultural product, a second station comprising second elements for the individual handling of respective horticultural products and at least one device for weighing each horticultural product in transit, controlled by said electronic control and management unit, and a third station comprising third elements for the individual handling of respective horticultural products and means for the selective conveyance of each horticultural product in transit toward one of at least two collection stations, which can be actuated by said electronic control and management unit to sort the horticultural products into at least two corresponding uniform subgroups as a function of the information acquired by said vision system and/or by said weighing device, wherein said second station comprises an intermediate unloading assembly, which can be actuated selectively by said electronic control and management unit for the early release of the horticultural products, handled by said second elements.

2. The apparatus according to claim 1, wherein for each horticultural product in transit in said second station, said electronic control and management unit is configured at least to compare the match between a preset parameter and the corresponding information acquired from said vision system and said weighing device, arranged upstream of said intermediate unloading assembly, said electronic control and management unit being configured for the timely actuation of said intermediate unloading assembly upon the occurrence of said match.

3. The apparatus according to claim 2, wherein said parameter is chosen so as to indicate the rotting of the horticultural product in transit.

4. The apparatus according to claim 1, wherein each one of said second elements comprises a grip clamp, provided with arms that can move between an active configuration, in which said arms are retained so as to clamp a respective horticultural product for transfer along said second station, and a passive configuration, in which said arms are kept mutually spaced, each one of said clamps being provided with a button for actuating the transition from said active configuration to said passive configuration, at a terminal area of said second station, which is proximate to said third station, there being a fixed body for affecting said button, for the automatic delivery of each horticultural product in transit to said third elements.

5. The apparatus according to claim 4, wherein said intermediate unloading assembly comprises a movable body for affecting said buttons, which is arranged upstream of said fixed body and can be actuated selectively for the reversible transition from an inactive position, in which it does not interfere with the passage of said buttons, to an active position, in which it is arranged so as to affect said buttons, in order to cause the transition from said active configuration to said passive configuration and the consequent early release of the horticultural products, upstream of said third station.

6. The apparatus according to claim 5, wherein said intermediate unloading assembly comprises a control actuator, which can be actuated selectively by said electronic and management unit, for said movable body, constituted by a profiled cam, which oscillates between said active position, in which a said cam is arranged so as to affect said buttons, and said passive position, in which said cam does not interfere with the passage of said buttons.

7. The apparatus according to claim 1, wherein said first elements, said second elements and said third elements are offset along two respective side-by-side trajectories for the advancement of the horticultural products, in each said station, and due to the offset, each said element, movable along one of said trajectories, being misaligned transversely with respect to the corresponding said elements, which can move along the other one of said trajectories.

8. The apparatus according to claim 7, wherein each one of said first elements, which can move cyclically along a first partial portion of one of said trajectories, comprises at least one pair of rollers, which are arranged mutually close with a horizontal longitudinal axis that is perpendicular to said first partial portion, in order to constitute jointly a resting element for a respective horticultural product, each one of said rollers being moved by a respective first traction apparatus along a first closed path, which forms with one of its parts a corresponding said first partial portion.

9. The apparatus according to claim 7, wherein each one of said third elements, which can move cyclically along a third partial portion of one of said trajectories, arranged downstream of said second station, comprises a tray that is adapted to support and contain a respective horticultural product, each one of said trays being moved by a respective third apparatus for traction along a third closed path, which forms with one of its parts a corresponding said third partial portion.

10. The apparatus according to claim 9, wherein each one of said trays can rotate at least partially about a main axis that is transverse to the corresponding said third portion, for temporary transition, controlled by means for the selective conveyance, from a horizontal arrangement, in which the respective horticultural product is normally conveyed along the corresponding said third portion, to an inclined arrangement, for the release of the corresponding said horticultural product toward one of said collection stations.

* * * * *